US009738356B2

(12) United States Patent
Peter

(10) Patent No.: US 9,738,356 B2
(45) Date of Patent: Aug. 22, 2017

(54) SURFBOARD WITH AN IMPROVED STRINGER

(71) Applicant: Benjamin R. Peter, Egg Harbor Township, NJ (US)

(72) Inventor: Benjamin R. Peter, Egg Harbor Township, NJ (US)

( * ) Notice: Subject to any disclaimer, the term of this patent is extended or adjusted under 35 U.S.C. 154(b) by 0 days.

(21) Appl. No.: 14/873,312

(22) Filed: Oct. 2, 2015

(65) Prior Publication Data

US 2017/0096198 A1 Apr. 6, 2017

(51) Int. Cl.
*B63B 35/81* (2006.01)
*B63B 35/79* (2006.01)

(52) U.S. Cl.
CPC ..... *B63B 35/7906* (2013.01)

(58) Field of Classification Search
CPC ..... B63B 35/7906
See application file for complete search history.

(56) References Cited

U.S. PATENT DOCUMENTS

| | | | | |
|---|---|---|---|---|
| 4,426,822 | A * | 1/1984 | Gailey | E04B 9/366 52/506.06 |
| 4,531,922 | A | 7/1985 | Schutz | |
| 5,224,890 | A | 7/1993 | Moran | |
| 6,036,560 | A | 3/2000 | Pekar | |
| 7,344,425 | B2 | 3/2008 | Yeh | |
| 7,938,705 | B2 | 5/2011 | Fitzgerald | |
| 2004/0226500 | A1* | 11/2004 | Stinson | B63B 5/24 114/357 |
| 2005/0247240 | A1* | 11/2005 | Nelson | B65D 19/0012 108/51.3 |
| 2009/0280704 | A1 | 11/2009 | Fort | |
| 2012/0263916 | A1* | 10/2012 | Green | B32B 3/02 428/138 |
| 2013/0231014 | A1* | 9/2013 | Knutson | B63H 16/00 440/21 |

* cited by examiner

*Primary Examiner* — Stephen Avila
(74) *Attorney, Agent, or Firm* — Norman E. Lehrer

(57) ABSTRACT

A water sports board with enhanced flexibility includes an elongated core body and an elongated wooden or carbon fiber planar stringer disposed on the centerline of the core body. A plurality of elongated slots are formed in the upper edge of the stringer and extend downwardly toward the bottom edge. The slots are filled with an elastic rubber-like material. The water sports board can be a surfboard, wind-surfing board, kite board, wakeboard or body boards.

13 Claims, 7 Drawing Sheets

SURFBOARD WITH AN IMPROVED STRINGER

BACKGROUND OF THE INVENTION

The present invention is directed toward surfboards and similar boards used for water sports and more particularly, toward such boards that have an improved stringer that allows for improved and selective flexibility of the board.

Board-shaped riding vehicles have long been a part of water recreation, first as surfboards, and later as sail boards and body boards and the like. Originally, most surfboards were manufactured to be stiff and heavy, with hard exterior surfaces. In more recent years, however, surfboard and sail board manufacturers have utilized synthetic materials to make lightweight boards, and body boards are normally constructed from soft foam materials.

Most currently available surfboards generally have light density core material glued to a wood stringer positioned at a longitudinal centerline with the entire core and stringer then covered by a hard exterior skin layer. The purpose of the stringer is to provide structural strength to the surfboard. As can be appreciated, the flexibility of the stringer directly affects the flexibility of the surfboard.

Surfboards are required to flex some amount and at desired locations which may change depending on the surfing conditions and the skill level of the surfer. As pointed out above, almost all commercially available surfboards have one, or sometimes two, thin planar wood stringers that increase the strength of the board that is necessary because of the light density of the core material currently used.

The flex patterns and characteristics exhibited by existing surfboards are random, not pre-determined and less than optimal. This is mainly due to the random flex characteristics and resistance to flexing of the solid body stringer. Moreover, the material types and the width of the stringers also play a role in the random and uncontrolled flex characteristics. Because of limited flexibility, existing surfboards tend to break easily under harsh wave conditions or repetitive uses.

Therefore, it is desirable to provide a water sports board having an improved flexibility. It is further desirable to provide a water sports board with selected or predetermined desired flex patterns, which ultimately enhances maneuverability and performance of the board to the rider. Moreover, it is also desirable to provide water sports boards with improved shock dampening property to enhance durability of the boards particularly in extreme environments.

One suggestion for improving the flexibility characteristics of a surfboard is disclosed in U.S. Published Application No. 2009/0280704 to Fort. Fort proposed cutting holes or windows through the side of the stringer. While this may weaken the stringer allowing it to flex laterally, it does not increase the flexibility of the stringer or of the surfboard in any direction within the plane of the stringer, thereby limiting its effectiveness. Furthermore, when the surfboard core material is glued onto the stringer, the glue can enter the formed openings and solidify, which makes the stringer more rigid, thereby again reducing the flexibility of the stringer and the surfboard.

A need continues to exist, therefore, for an arrangement that allows a surfboard manufacturer to produce a surfboard with specifically desired flexibility characteristics.

SUMMARY OF THE INVENTION

The present invention is designed to overcome the deficiencies of the prior art discussed above. It is an object of the present invention to provide a water sports board with enhanced flexibility.

It is another object of the present invention to provide a method for constructing a water sports board which allows the maker to readily adjust the flexibility of the same during construction.

It is a still further object of the present invention to provide such a water sports board that can be produced with a desired flexibility.

In accordance with the illustrative embodiments demonstrating features and advantages of the present invention, there is provided a water sports board with enhanced flexibility that includes an elongated core body and an elongated wooden or carbon fiber planar stringer disposed on the centerline of the core body. A plurality of elongated slots are formed in the upper edge of the stringer and extend downwardly toward the bottom edge. The slots may be filled with an elastic rubber-like material. The water sports board can be a surfboard, windsurfing board, kite board, wakeboard or body boards.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
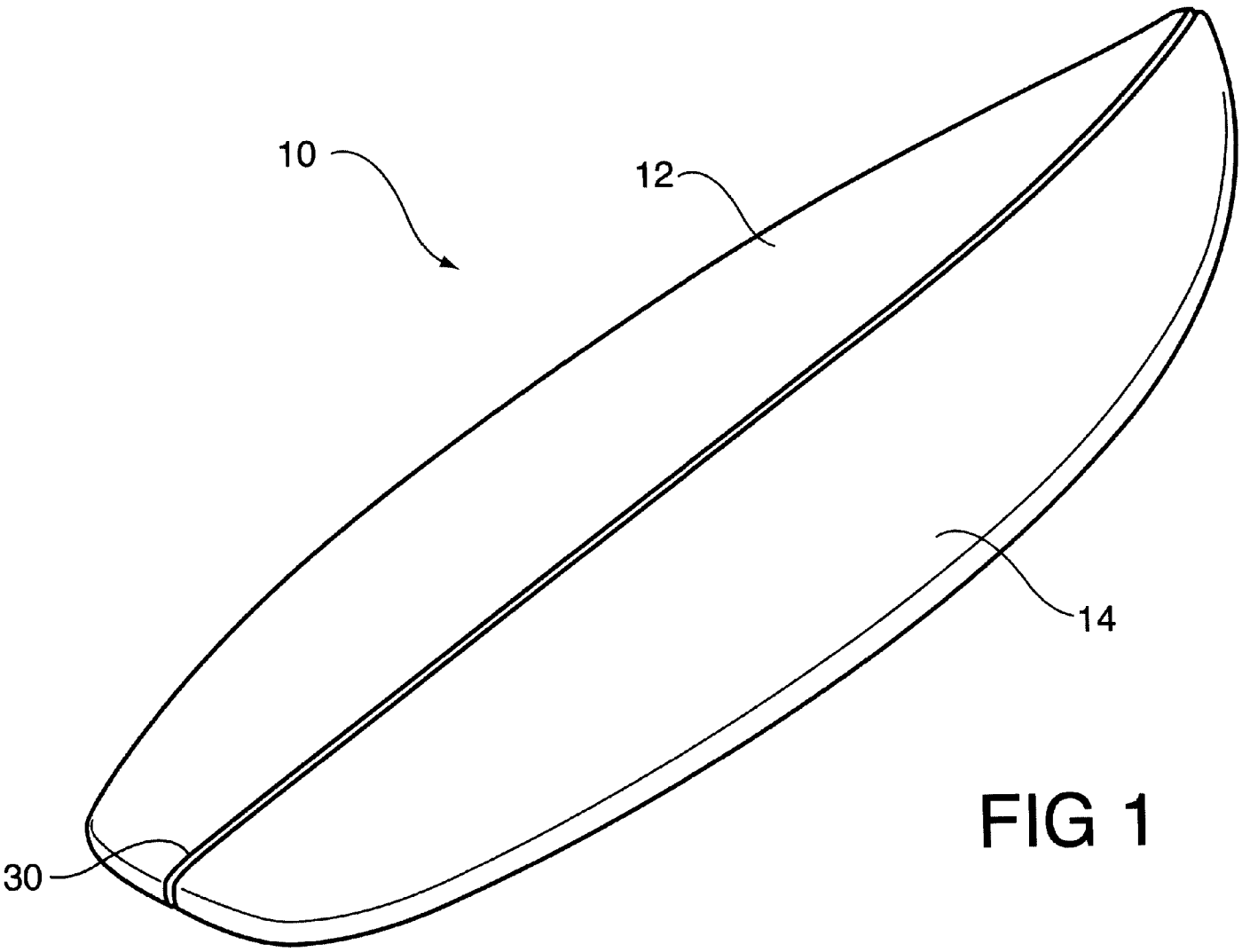
FIG. 1 is a perspective view of the core of a surfboard.

Referring now to the drawings in detail wherein like reference numerals have been used throughout the various figures to designate like elements, there is shown in FIGS. 1-7 an improved surfboard core constructed in accordance with the principles of the present invention and designated generally as 10. The core 10 shown in FIG. 1 is covered with fiberglass or other similar fabric material which is normally bonded thereto in a manner well known in the art to form a hard exterior skin layer. Accordingly, a detailed description thereof is not believed to be necessary.

The surfboard core 10 is comprised of several component parts including two substantially symmetrical halves 12 and 14 each of which has a nose end such as shown at 16 and 18 and a tail end shown at 20 and 22. The core halves 12 and 14 also have top surfaces 24 and 26 and bottom surfaces, only one of which, 28, is shown in the figures.

As is well known in the art, the surfboard has a defined curved shape which is shown in the figures. This is, of course, by way of example only as various other shapes are known. The length and width and curvature of the board depends on the use to which it is going to be put and, frequently, the skill of the person utilizing the same.

The two core body halves 12 and 14 are preferably comprised of lightweight, synthetic plastic materials. Frequently these are relatively dense foam materials. This helps to make the boards lighter and more flexible.

Located along the center line between the core body halves 12 and 14 is an elongated planar stringer 30. The stringer has a height which goes from the top edge 32 to the bottom edge 34 thereof and a front end 36 and front rear end 38 and two side surfaces 40 and 42.

Figure 2:
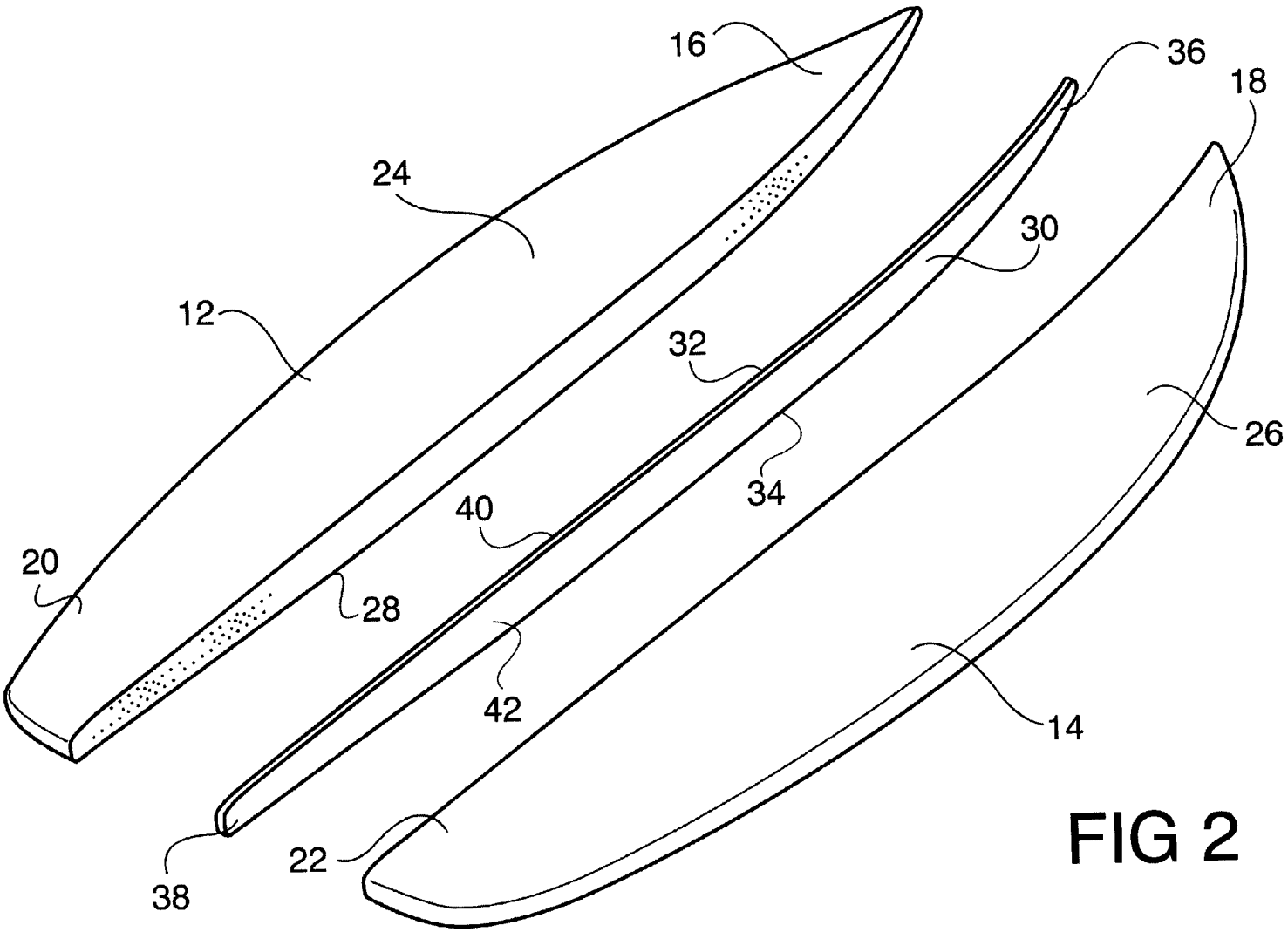
FIG. 2 is an exploded perspective view showing the principal component parts of the surfboard core.

In the most common manufacturing process, the core body 10 is prepared by assembling a somewhat rectangularly shaped stringer between two substantially rectangularly shaped core halves and then machining the combination into the desired curved shape. One method of practicing the present invention is to then remove the three component parts 12, 14 and 30 as shown in FIG. 2 by ungluing them. It is not beyond the scope of the present invention, however, to start with the three component parts already shaped and then assembling them.

Figure 3:
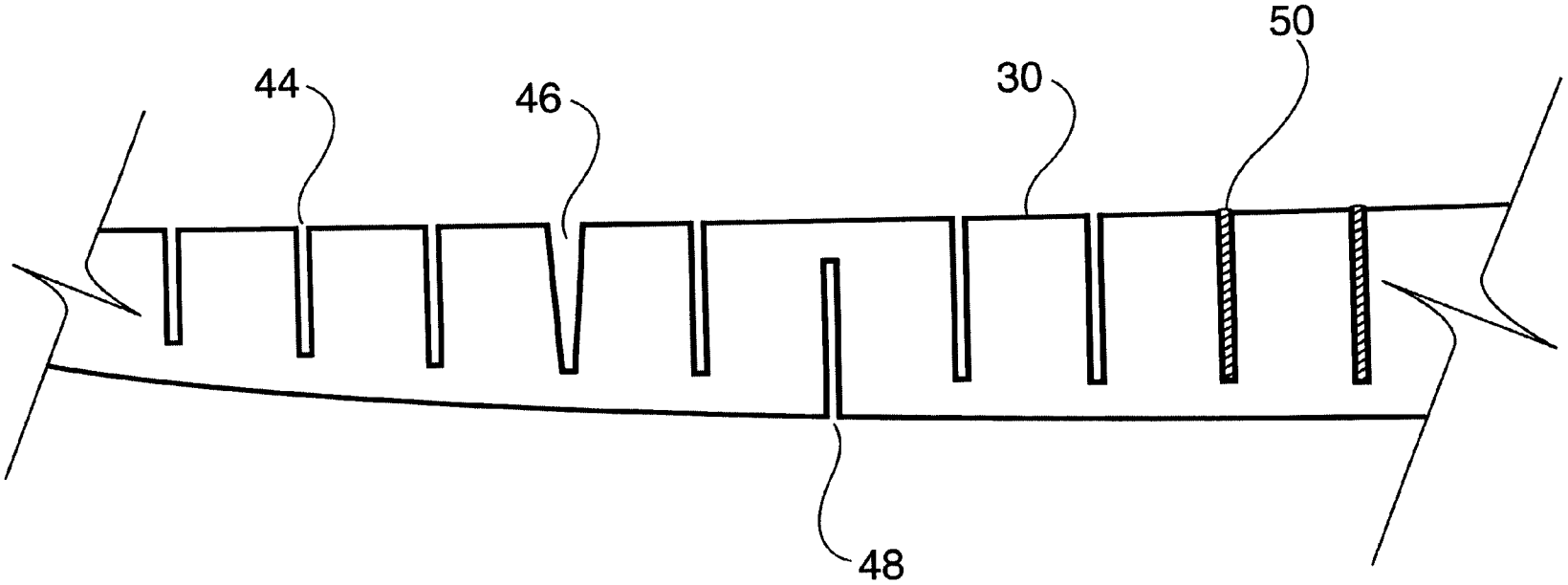
FIG. 3 is a side elevational view of the improved stringer of the present invention.

As shown most clearly in FIG. 3, a plurality of slots or notches 44 are formed in the stringer 30. The notches are preferably formed in the upper edge 32 and extend downwardly toward but not completely through to the lower edge 34. The number, size and shaping of the slots 44 will depend on the degree of flexibility that is desired and the position on the board where the flexibility is desired.

In the preferred embodiment, the slots 44 are formed in the top edge of the board and extend substantially vertically downwardly. It is not beyond the scope of the present invention, however, for the slots to extend downwardly at an angle nor is it required that they have straight side walls. Other arrangements are possible. By way of example and not limitation, the slots could be triangularly shaped such as shown at 46. Furthermore, in some situations, it may be desirable to include a slot that goes upwardly such as shown at 48.

Figure 4:
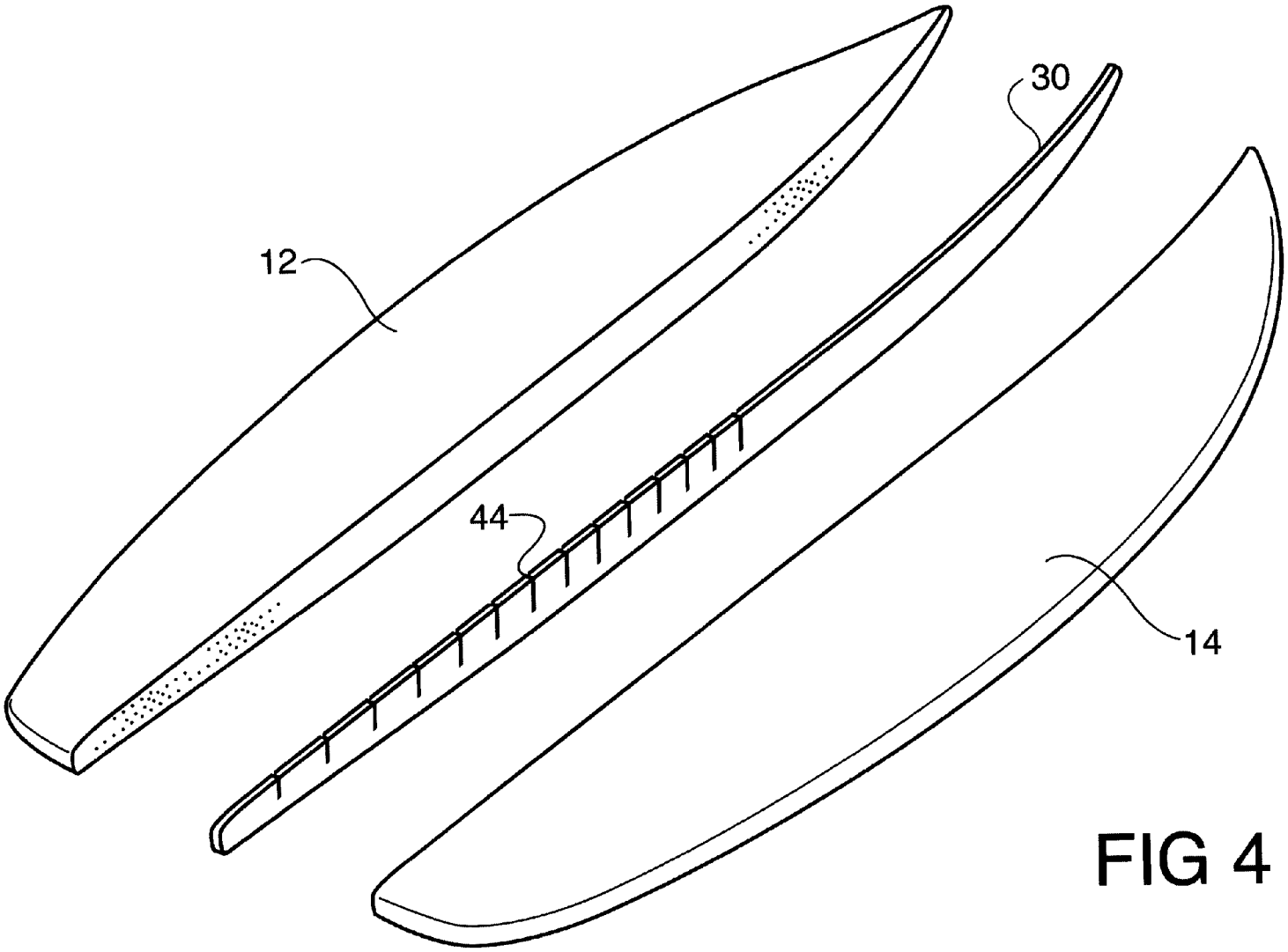
FIG. 4 is a perspective view similar to FIG. 2 but showing the improved stringer being utilized.
Figure 5:
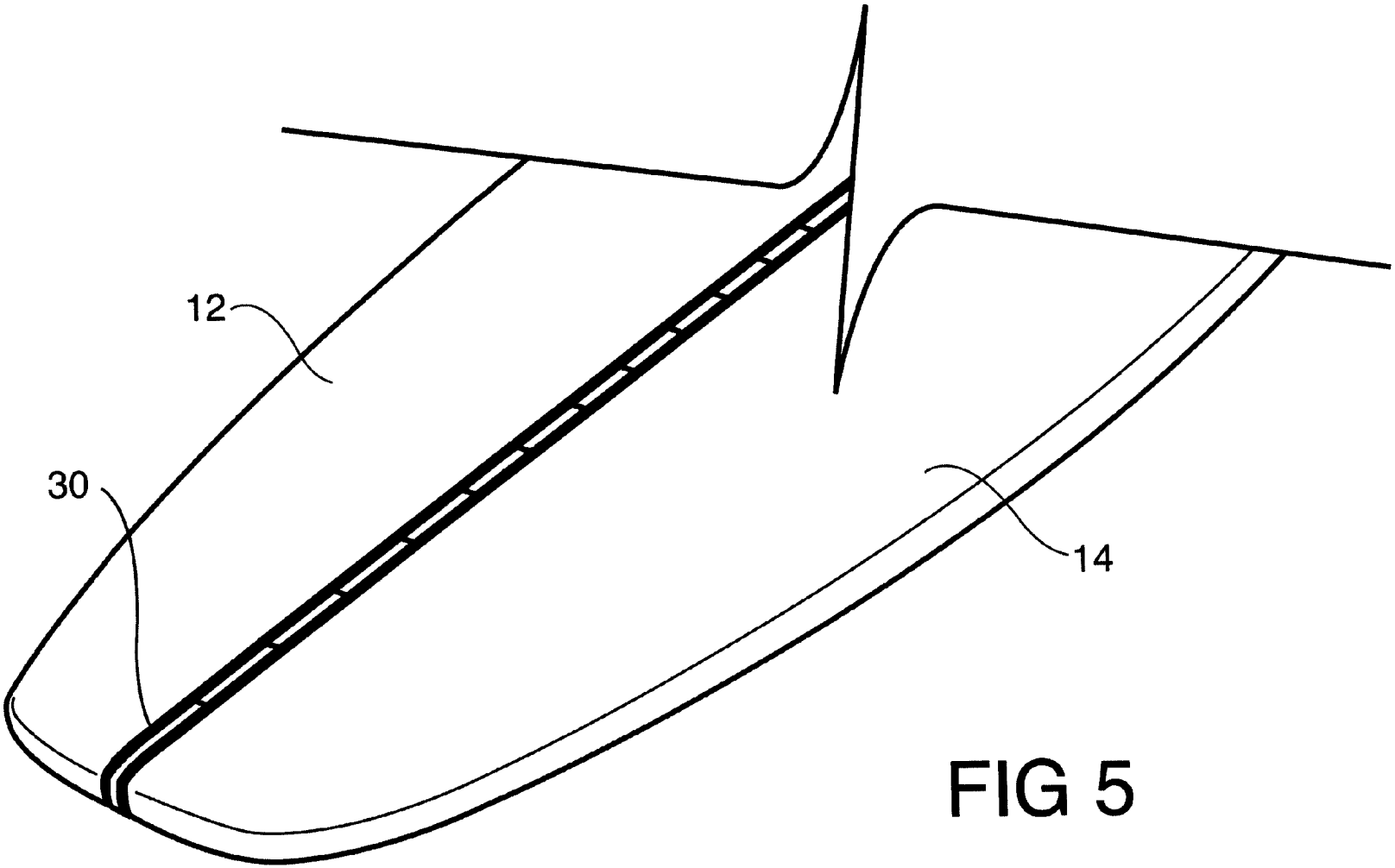
FIG. 5 is a perspective view similar to FIG. 1 but showing the surfboard core reassembled with the improved stringer therein.

After the stringer is provided with the desired slots such as shown in FIG. 3, the two halves 12 and 14 of the core are glued to the side faces 40 and 42 of the stringer as shown in FIGS. 4 and 5. The core is then covered with a hard exterior skin layer as discussed above. During this assembly, gluing and covering process, rigid adhesive material can flow into the slots. To prevent this and to provide further control over the flexibility of the stringer, some or all of the slots can be filled with a rubbery or elastic material such as shown at 50 in FIG. 3.

Figure 6:
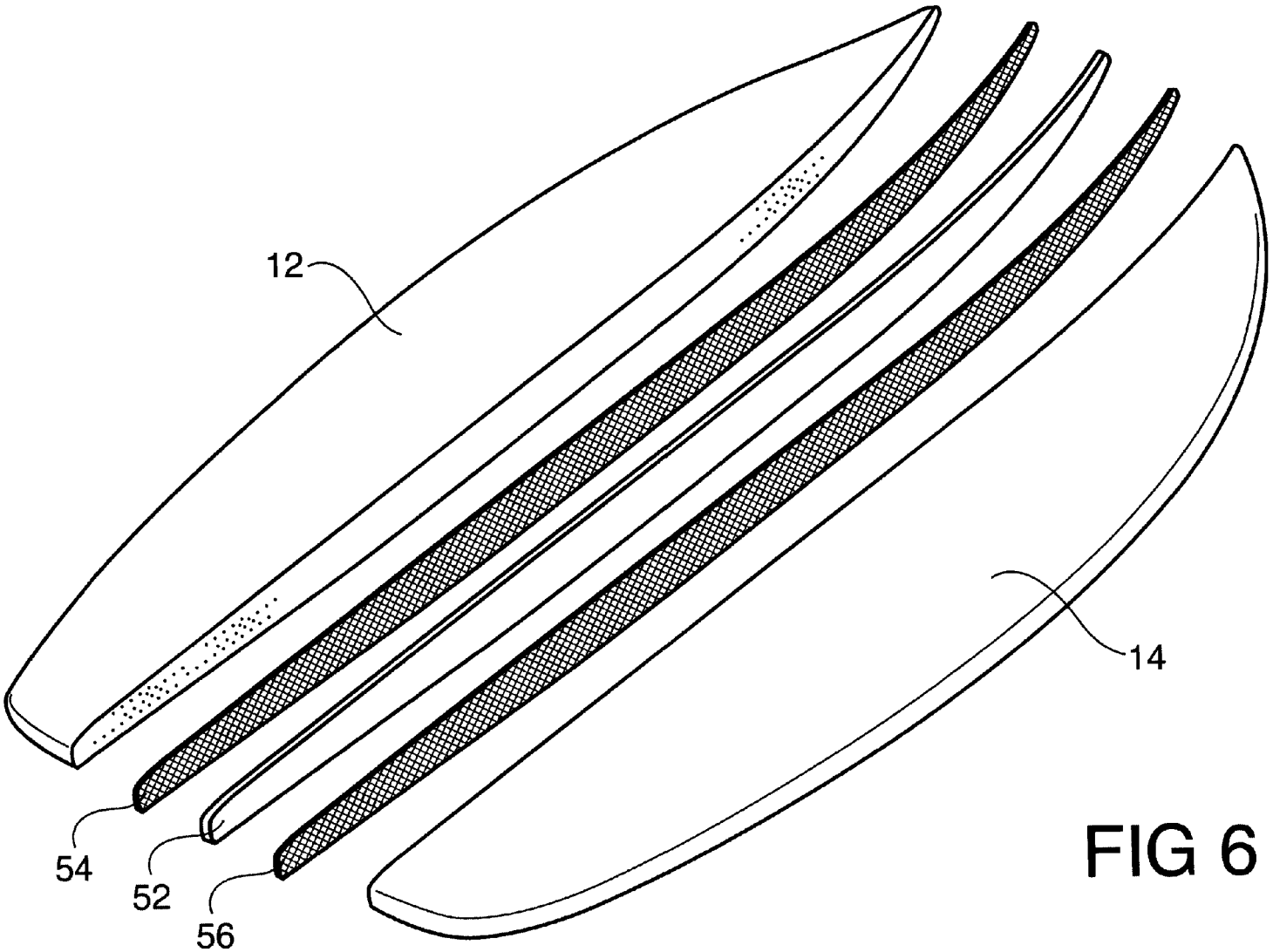
FIG. 6 is a perspective view similar to FIG. 2 but showing a modified form of the stringer being assembled.
Figure 7:
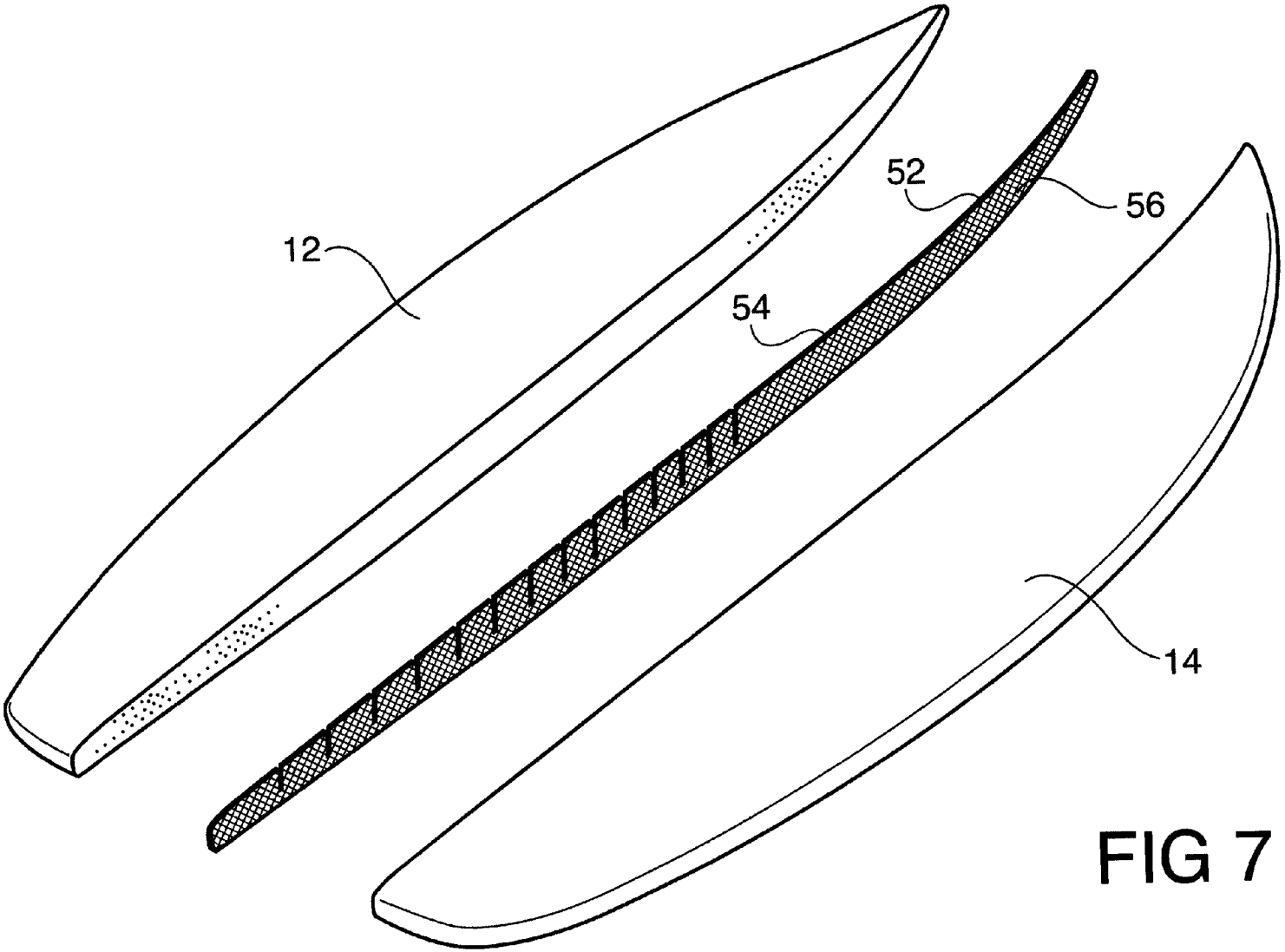
FIG. 7 is a perspective view similar to FIG. 2 showing the use of the improved modified form of the stringer of FIG. 6.

The stringer of the present invention and those that are conventional in the art are frequently made of wood. It is possible, however, to make the stringer of other materials such as carbon fiber. Furthermore, and as shown in FIGS. 6 and 7, the stringer can be a laminate having a center 52 of wood between two carbon fiber layers 54 and 56 as shown in FIGS. 6 and 7. In this embodiment, the laminate is preferably combined before the slots are formed therein.

Although reference has been made herein to a surfboard, it should be readily apparent that substantially any water sports board can be made in accordance with the present invention. This would include surfboards, wind surfing boards, kite boards, wakeboards and body boards.

The present invention may be embodied in other specific forms without departing from the spirit or essential attributes thereof and accordingly, reference should be made to the appended claims rather than to the foregoing specification as indicating the scope of the invention.

I claim:

1. A water sports board having enhanced flexibility comprising:

an elongated core body having a nose end and a tail end, and top and bottom surfaces defining a curved shape of said water sports board;

an elongated planar stringer disposed on a longitudinal centerline of said core body, said stringer having a height and a front end and a rear end, two side surfaces and a top edge and a bottom edge, a plurality of slots formed in one of said edges and extending through a portion of the height thereof toward the other of said edges, and additional material located within said slots.

2. The water sports board as claimed in claim 1 wherein said elongated core body includes two substantially symmetrical halves, each half being secured to one of said side surfaces of said planar stringer.

3. The water sports board as claimed in claim 1 wherein at least one of said slots is substantially rectangular in shape.

4. The water sports board as claimed in claim 1 wherein at least one of said slots is substantially triangular in shape.

5. The water sports board as claimed in claim 1 wherein at least one of said slots is formed in said upper edge and extends downwardly toward said lower edge.

6. The water sports board as claimed in claim 5 wherein a plurality of said slots are formed in said upper edge and extend downwardly toward said lower edge.

7. The water sports board as claimed in claim 1 wherein at least one of said slots is formed in said lower edge and extends upwardly toward said upper edge.

8. The water sports board as claimed in claim 1 wherein the additional material located within said slots includes an elastic material.

9. The water sports board as claimed in claim 1 wherein said slots have a height equal to at least half of said height of said stringer.

10. The water sports board as claimed in claim 1 wherein said stringer is comprised of wood.

11. The water sports board as claimed in claim 1 wherein said stringer is comprised of carbon fiber.

12. The water sports board as claimed in claim 1 wherein said stringer is comprised of wood laminated with carbon fiber.

13. The water sports board as claimed in claim 1 wherein said water sports board is one of a surfboard, windsurfing board, kite board, wakeboard and body board.

* * * * *